US011353192B1

(12) United States Patent
Howe

(10) Patent No.: US 11,353,192 B1
(45) Date of Patent: Jun. 7, 2022

(54) LIGHT MODIFYING APPARATUS WITH ADJUSTABLE MULTI SEGMENTED REFRACTION ZONES

(71) Applicant: Leslie David Howe, Ottawa (CA)

(72) Inventor: Leslie David Howe, Ottawa (CA)

( * ) Notice: Subject to any disclaimer, the term of this patent is extended or adjusted under 35 U.S.C. 154(b) by 0 days.

(21) Appl. No.: 17/173,391

(22) Filed: Feb. 11, 2021

(51) Int. Cl.

| | |
|---|---|
| ***F21V 5/04*** | (2006.01) |
| ***F21V 29/70*** | (2015.01) |
| ***F21V 13/04*** | (2006.01) |
| ***F21V 17/00*** | (2006.01) |
| ***F21V 7/00*** | (2006.01) |
| *F21Y 115/10* | (2016.01) |
| *F21Y 103/10* | (2016.01) |

(52) U.S. Cl.
CPC ..... *F21V 5/045* (2013.01); *F21V 7/005* (2013.01); *F21V 13/04* (2013.01); *F21V 17/002* (2013.01); *F21V 29/70* (2015.01); *F21Y 2103/10* (2016.08); *F21Y 2115/10* (2016.08)

(58) Field of Classification Search
CPC ..... F21V 11/16–186
See application file for complete search history.

(56) References Cited

U.S. PATENT DOCUMENTS

| | | | | |
|---|---|---|---|---|
| 6,742,914 | B2 * | 6/2004 | Prodell | G02B 6/0046 362/329 |
| 2009/0305002 | A1 * | 12/2009 | Su | C09K 9/02 428/174 |
| 2012/0236595 | A1 * | 9/2012 | Parker | F21V 9/30 362/609 |
| 2014/0098546 | A1 * | 4/2014 | Takahashi | F21V 5/00 362/311.01 |
| 2014/0211484 | A1 * | 7/2014 | Howe | F21V 13/02 362/326 |
| 2016/0305619 | A1 * | 10/2016 | Howe | F21V 17/101 |
| 2016/0327215 | A1 * | 11/2016 | Rijken | F21K 9/90 |
| 2017/0156192 | A1 * | 6/2017 | Chern | F21V 5/04 |
| 2017/0299153 | A1 * | 10/2017 | Hsu | F21V 17/002 |
| 2018/0195684 | A1 * | 7/2018 | Vissenberg | F21V 5/045 |
| 2020/0088384 | A1 * | 3/2020 | Chiu | F21V 5/004 |

* cited by examiner

*Primary Examiner* — Rajarshi Chakraborty
*Assistant Examiner* — Michael Chiang

(57) ABSTRACT

A light modifying apparatus is provided, which may comprise a curved outer layer comprising a substrate configured to modify light, wherein the curved outer layer may have an arc of length X. A second curved me be disposed on, or in close proximity to the back surface of the outer layer, and wherein the second curved layer may have an arc of length Y wherein length Y is less than length X, and wherein the second curved layer may comprise a substrate comprising one or more surfaces comprising a lenticular lens configuration. An optional third layer may be provided which may comprise a substrate comprising one or more surfaces comprising a lenticular lens configuration.

6 Claims, 10 Drawing Sheets

2

LIGHT MODIFYING APPARATUS WITH ADJUSTABLE MULTI SEGMENTED REFRACTION ZONES

TECHNICAL FIELD

This disclosure generally relates to the field of lighting.

BACKGROUND

There is a continuing need for improved optical systems for luminaires, especially as it relates to LED luminaires and glare.

DETAILED DESCRIPTION

Figure 1:
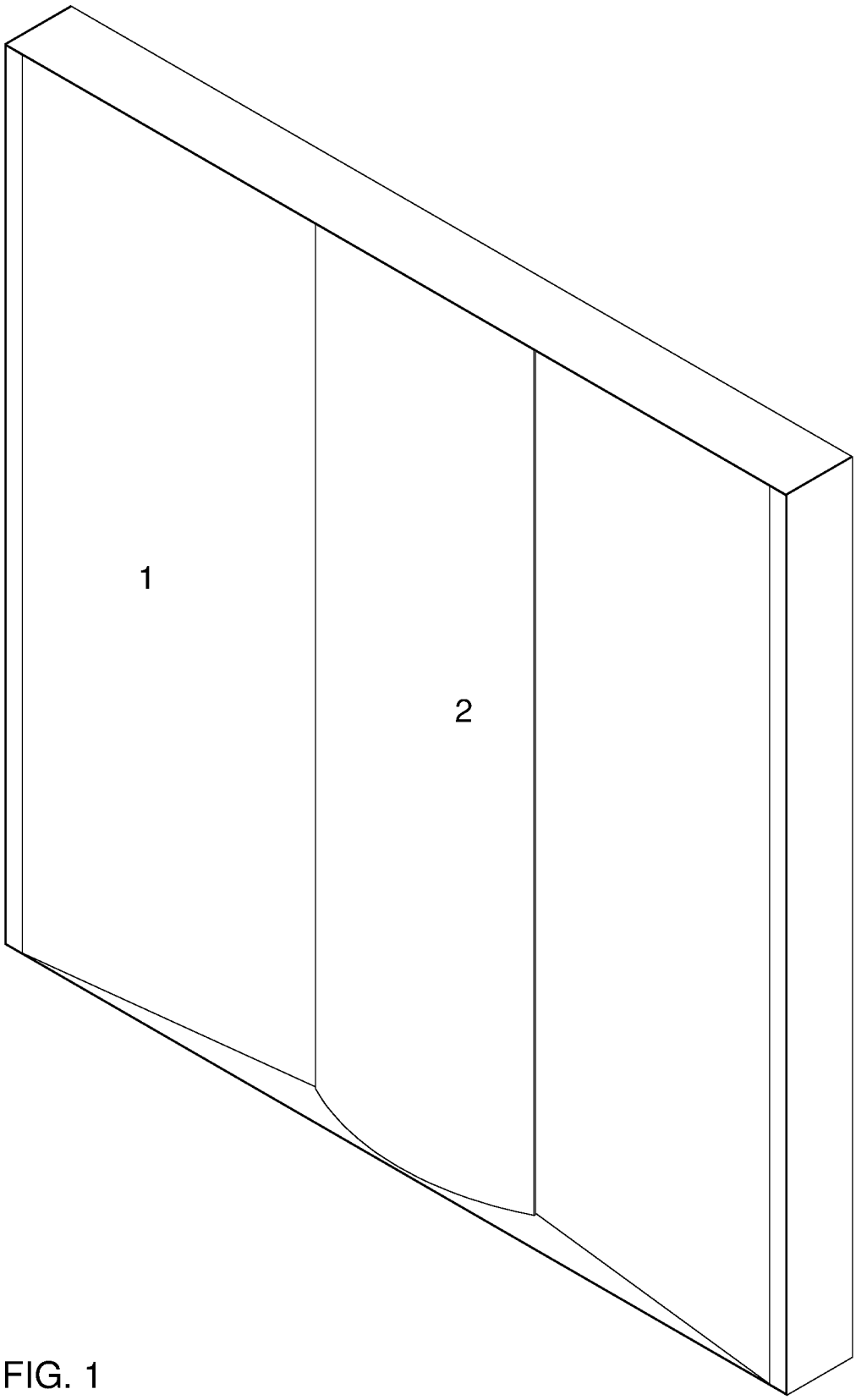
FIG. 1 shows a perspective view of an example embodiment of light modifying apparatus with adjustable multi-segmented refraction zones ("The Apparatus") installed in a luminaire.

In an example embodiment of the claimed invention, FIG. 1 shows a typical LED luminaire troffer body 1 and an example embodiment of light modifying apparatus with adjustable multi-segmented refraction zones ("The Apparatus") 2. FIG. 2A shows a perspective view of an example embodiment of The Apparatus, and FIG. 2B shows an inverted perspective view of the same. The Apparatus may comprise an outer lens layer 4, which may be attached to an LED heat sink 3.

Example embodiments of The Apparatus described in this application herein may comprise optical films and may be discussed with reference to optical films (which will be subsequently described in greater detail). However, this should not be construed to limit the scope of embodiments of the claimed invention. Other substrates may be substituted for optical films that may function in a similar manner to optical films utilized in example embodiments. For example, extruded PMMA acrylic or Poly Carbonate (PC) with laser etched or embossed surface features may be utilized. Extruded PMMA acrylic or PC may also comprise deposited surface coatings which may also function in a similar manner to certain optical films utilized in example embodiments.

Example embodiments of The Apparatus may be utilized in any type of luminaire body that may be suitable to an application. In example embodiments, The Apparatus may function by itself without a luminaire body. The type of luminaire body, or the inclusion or omission of a luminaire body should not be construed to limit the scope of example embodiments of The Apparatus.

Figure 4:
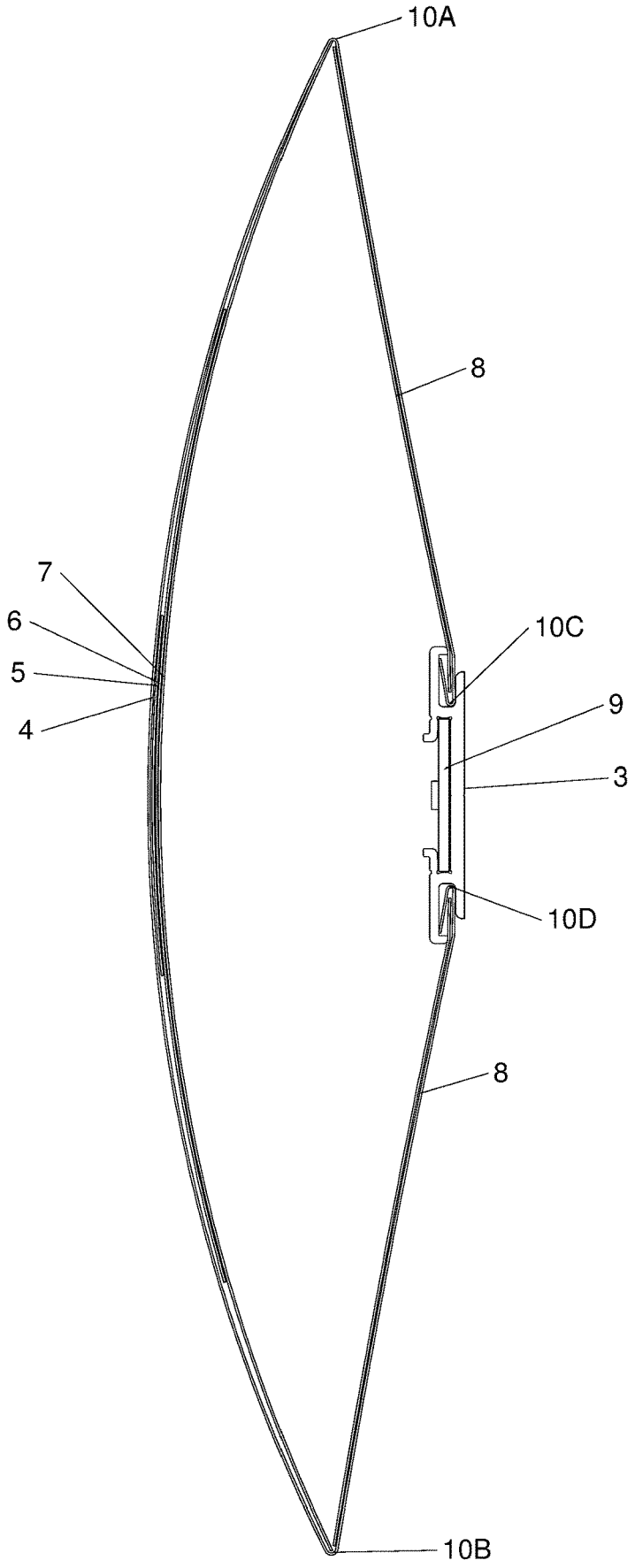
FIG. 4 shows a profile view of an example embodiment of The Apparatus which has been rotated 90 degrees from its operational position for illustrative purposes.

Some example embodiments may be shown with an integral light source such as sown in FIG. 4, which may include a heat sink 3 and one or more LED arrays 4. In other example embodiments, The Apparatus may not include a light source, and may be attached to a luminaire or external light source.

FIG. 4 shows a profile view of an example embodiment of The Apparatus, which is shown at a rotated 90-degree angle. Outer lens 4 may connect to LED heat sink 3 utilizing folds in the film 10C and 10D. The LED heat sink may comprise one or more LED arrays 9 attached therein. The outer lens 4 may be fabricated from diffusion film or any other substrates as discussed. The diffusion film may be any suitable optical film that may function to diffuse light to some degree. In example embodiments, it may be preferable that the diffusion film comprise light condensing properties. An example may be diffusion film with spherical glass beads deposited on at least one surface of a high clarity PET substrate, preferably on the outside surface (furthest away from the light source). The opposing surface may comprise an anti-wet out coating, which may prevent a condition commonly referred to as "wet out" when multiple layers of optical film are disposed on top of each other. In example embodiments, a thicker substrate such as 250 microns or greater may exhibit more robust physical characteristics. Any thickness of substrate may be utilized for the outer lens 4 that can function adequately in a given application.

Overlay 7 may comprise the same material as the outer lens 4, or any other suitable material as discussed. The overlay 7 may be fabricated as a rectangular sheet with its width being configured to a dimension that may allow it to laterally compress and slidingly engage with the outer lens 4 between the folds in the film 10A and 10B, and that may stay secure therein as a result of elastic potential energy. The space created between the front surface of overlay 7 and outer lens 4 may create a "pocket" which may allow further optical film pieces to float therein without any other means of attachment to The Apparatus. This may be a novel method of fixing multiple layers of optical films together in an optical film stack.

Figure 2:
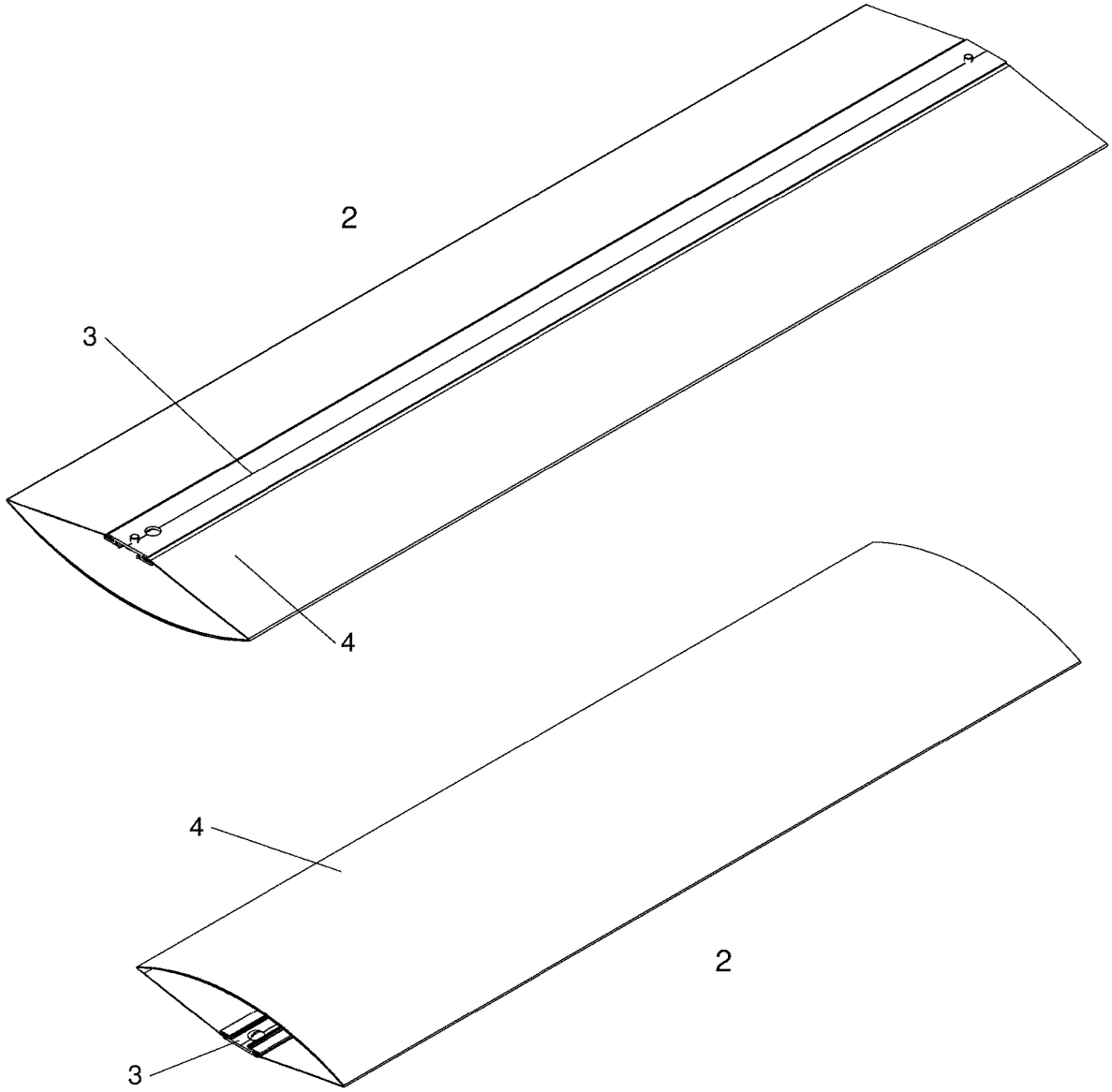
FIG. 2 shows two different perspective views of an example embodiment of The Apparatus wherein the second view is oriented 180 degrees compared to the first view.
Figure 3:
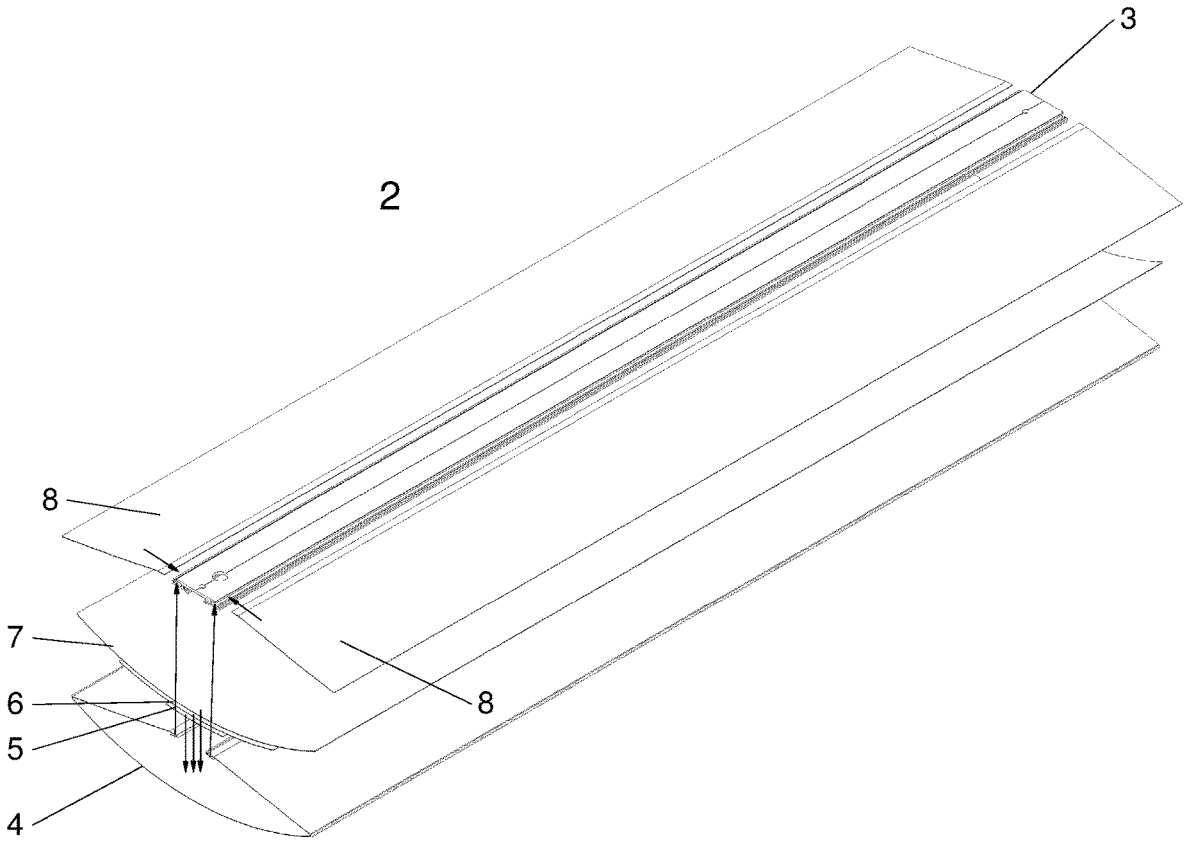
FIG. 3 shows an exploded perspective view of an example embodiment of The Apparatus.
Figure 5A:
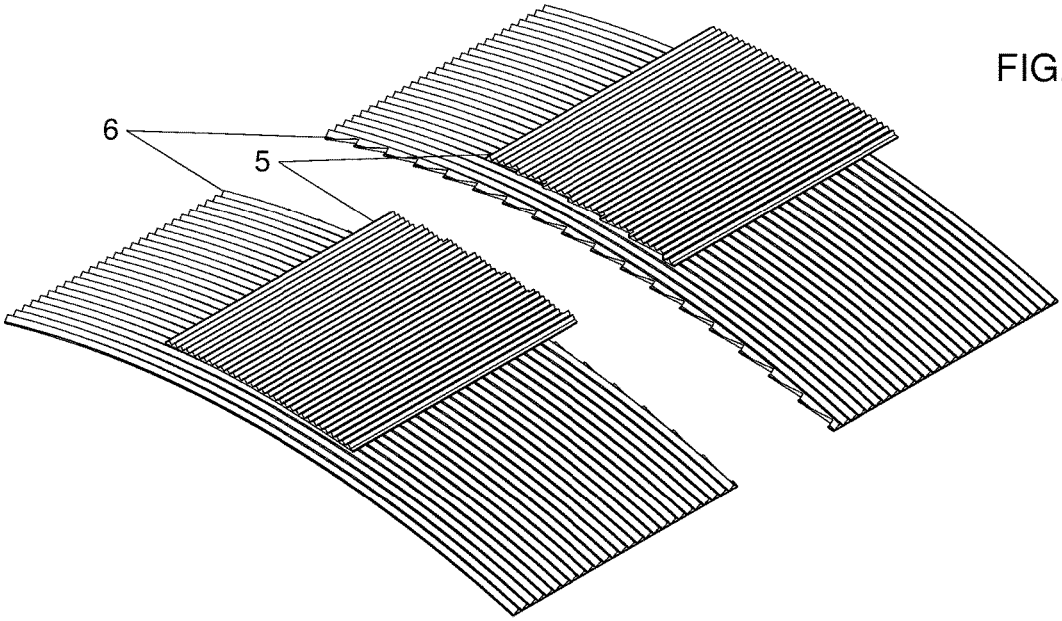
FIG. 5A shows a perspective view of two layers of prism film.
Figure 5B:
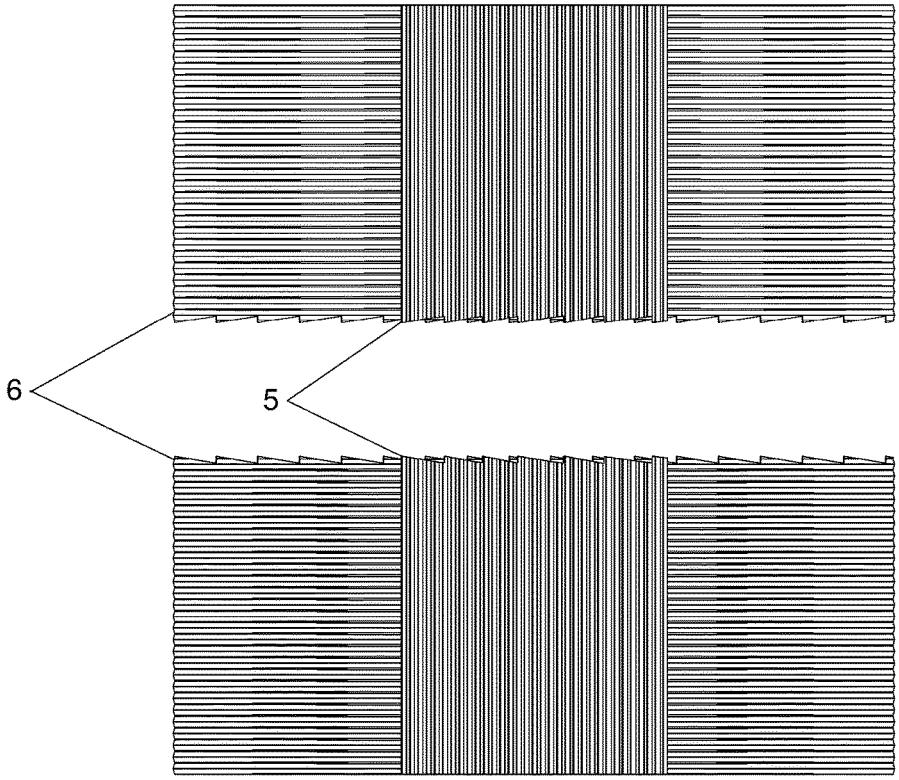
FIG. 5B shows a top view of two layers of prism film.

Referring to FIG. 5A in an example embodiment, a lenticular lens film piece ("LLFP1") is indicated by feature descriptive 5. LLFP1 5 may be disposed in a central orientation in the pocket. LLFP1 5 is shown in an upside-down orientation so the structured surface of the film may be seen. In an example embodiment, the lenticular lens film is prismatic film, such as 3M BEF film which is used in many display applications. The prism rows are oriented parallel to the outer edges of the outer lens 4 (FIG. 2). The size of the prism row has been greatly exaggerated for illustrative purposes, as the actual prism rows may not be visible with the naked eye. In an example embodiment, another lenticular lens film piece ("LLFP2") is indicated by feature descriptive 6. LLFP2 may be disposed on top of LLFP1 in a central orientation in the pocket as shown in FIG. 5A. As shown, the prism rows are at a ninety degree angle to the prism rows of LLFP1.

Any other type of lenticular lens films other than prism films may be utilized that may give the desired effects in a given application. Many different types of lenticular lens films may be available on the market, for example, films manufactured by Bright View Technologies, which may include different embossed or etched surface features comprising different shapes creating different light distribution patterns.

Example embodiments of The Apparatus need not include two different lenticular film pieces, and may comprise only one.

In an example embodiment, LLFP1 and or LLFP2 may be secured in place (FIG. 4) by alignment holes fabricated at both ends of both of them, along with the overlay 4, wherein a plastic push-in rivet may protrude through corresponding holes, thereby aligning and securing the film layers together. Any other suitable fastener may be utilized as well. In example embodiments, alignment holes may not be necessary. An alignment notch may be fabricated at each end of the overlay 7, LLFP1 5 and LLFP2 6, and once the film layers are aligned, a staple or other means of attachment may secure the film layers together.

In an example embodiment, reflectors 8 as shown in FIG. 4 may be disposed as shown. The reflectors may be important elements in providing good efficacy to The Apparatus due to the high levels of light recycling that may be the result of one or more substrate layers comprising one or more lenticular lens surfaces, as well as the bounce back from any of the substrate layers. The reflectors 8 may comprise any suitable reflection material, for example, White 97 from White Optics with a reflective efficiency of greater than 97% and a diffusion component of greater than 97%. Reflectors comprising the material as described may also help spreading the light from the LED source evenly within The Apparatus.

Figure 6A:
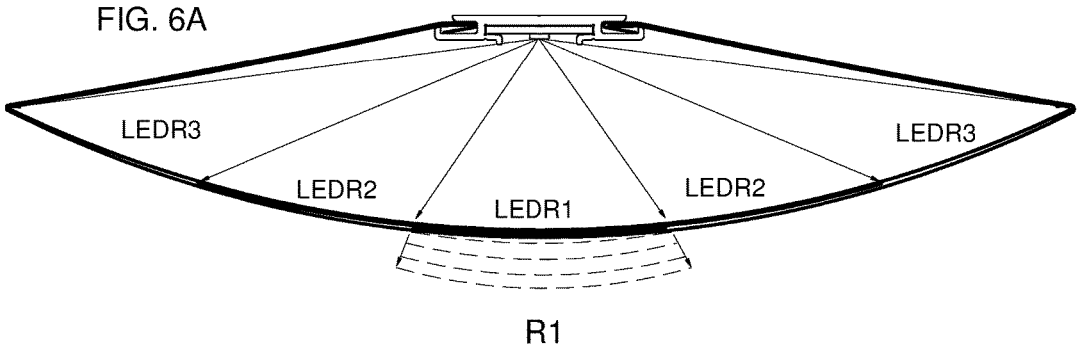
FIGS. 6A, 6B and 6C shows light distribution patterns of an example embodiment of The Apparatus.

Referring to FIG. 6A, example light rays as represented by zone LEDR1 may be emitted from the LED light source. LEDR1 may represent a section of beam angle of the highest intensity light emitted from the LED light source. Light rays refracted through the film layers in zone R1 may refract through two layers of light condensing diffusion film as well as two layers of prism film oriented at 90 degrees from each other as previously discussed. The refracted light may be condensed to a narrow beam angle, perhaps in the range of 50 degrees FWHM, and may have significantly increased candela values. The functioning of prism film, both single and crossed layers may be well known to the industry, and will not be reiterated here for brevity. This zone of higher intensity light may be centered around zero degrees NADIR when configured in a luminaire similar to that shown in FIG. 1 wherein the luminaire is installed on a ceiling. This zone of brighter light may not be objectionable to occupants, since occupants in practice may seldom look straight up.

Figure 6B:
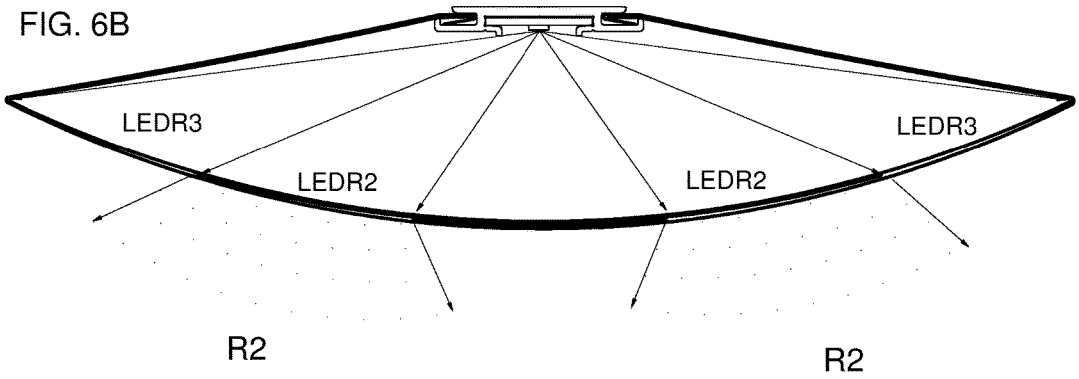

Referring to FIG. 6B, example light rays as represented by zone LEDR2 may be emitted from the LED light source. LEDR2 may represent a section of beam angle of less intense light emitted from the LED light source. Light rays refracted through the film layers in zone R2 may refract through two layers of light condensing diffusion film as well as one layer of prism film. The refracted light may be condensed to a relatively narrow beam angle, perhaps in the range of about 100 degrees FWHM, and may have moderately increased candela values. When The Apparatus has been configured with the applicable variations as will be discussed, and wherein the luminaire is installed on a ceiling, the light from the two R2 zones may be distributed around the work plane but have the majority of the light be dispersed below 60 degrees from NADIR to avoid higher angle glare above 60 degrees.

Figure 6C:
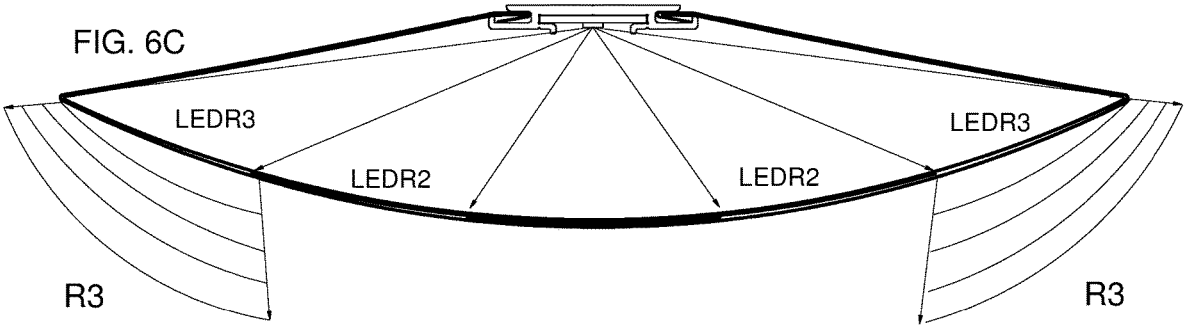

Referring to FIG. 6C, example light rays as represented by zone LEDR3 may be emitted from the LED light source. LEDR3 may represent a section of beam angle of the least intense light emitted from the LED light source. Light rays refracted through the film layers in zone R3 may refract through only the two layers of light condensing diffusion film. The refracted light may be condensed to wider beam angle compared to zones R1 and R2, and may have modestly increased candela values. This light zone may be partially distributed in the glare zone when configured in a luminaire similar to that shown in FIG. 1, wherein the luminaire is installed on a ceiling. This zone of the lowest intensity light may not be objectionable to occupants due to its low intensity. Additionally, a physical light cutoff may occur due to the luminaire's reflectors blocking the highest angles of light.

Figure 7:
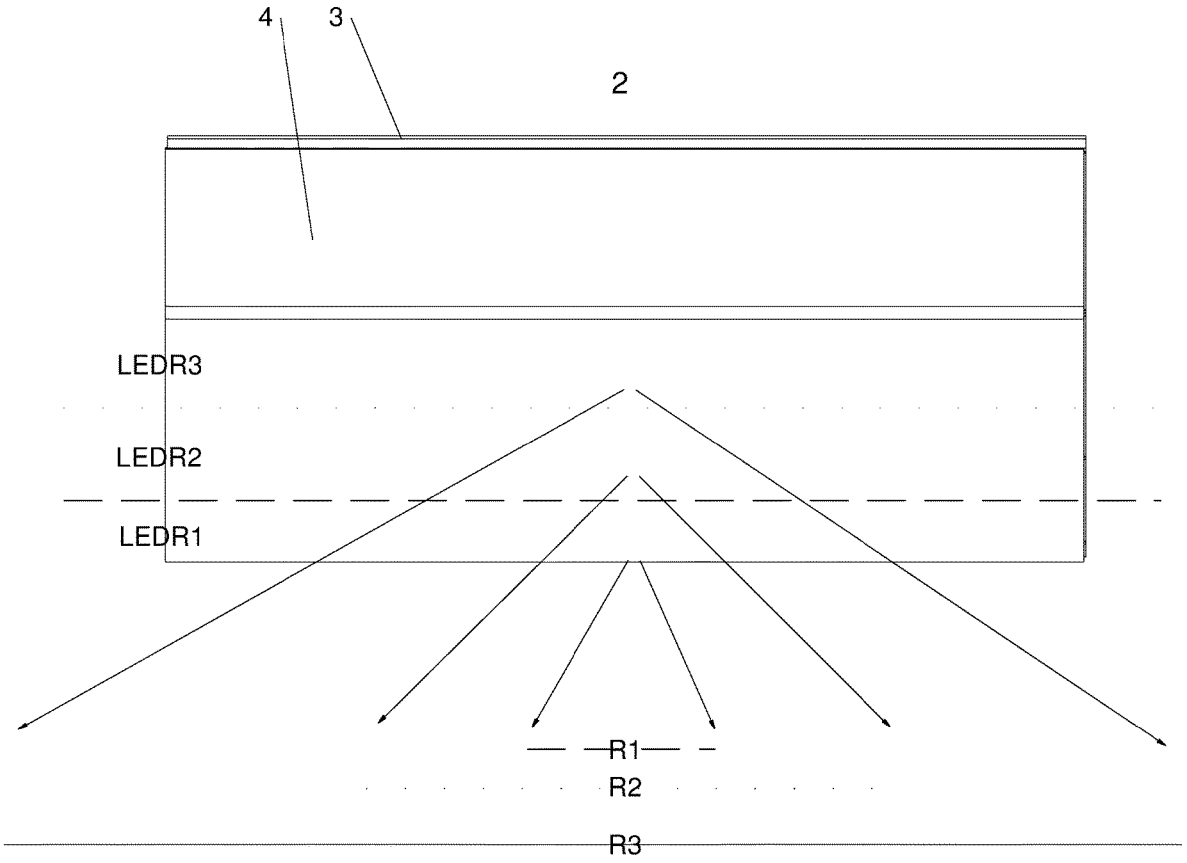
FIG. 7 shows a light distribution pattern of an example embodiment of The Apparatus shown in the plane that is rotated 90 degrees from the views shown in FIGS. 6A, 6B and 6C.
Figure 10:
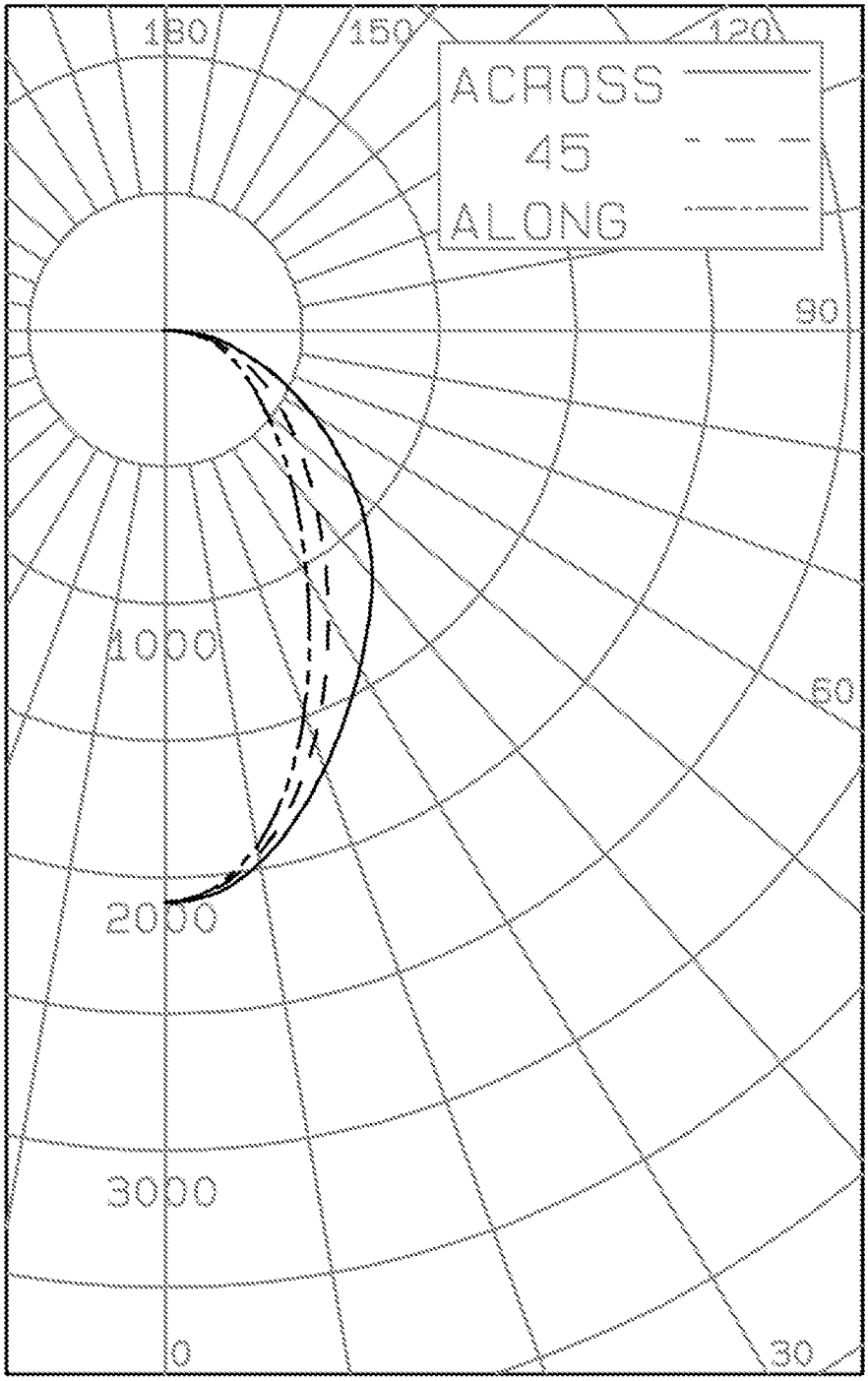
FIG. 10 shows a polar light distribution chart of an example embodiment of The Apparatus.

FIG. 7 shows a light distribution diagram of a similar example embodiment of The Apparatus as show in FIG. 6A-6C, except viewed from the plane that is rotated 90 degrees. The Apparatus 2, heat sink 3 and outer lens 4 are shown. The zones LEDR1, LEDR2 and LEDR3 may correspond to the zones shown in FIG. 6A-6C, and the refractions zones R1, R2 and R3 may correspond to the refractions zones shown in FIG. 6A-6C. With similar rational as discussed with respect to FIG. 6A-6C, refraction zones R1-R3 may have increasing wider beam angles, and the light distribution from The Apparatus may be similar from both the 0 degree and 90 degree planes. FIG. 10 shows a polar light distribution chart of an example embodiment of The Apparatus. As shown, the Along Plane (0 degrees) may have similar characteristics as the Across Plane (90 degrees).

A novel aspect of The Apparatus may be the adjustability of the light distribution pattern. Typically with extruded acrylic or PC lenses, a new lens with new tooling would need to be fabricated for each different light distribution pattern. The cost of doing so may not make economic sense. In example embodiments of The Apparatus, the light distribution curves may be modified utilizing at least two different methods as will be subsequently described.

Figure 8A:
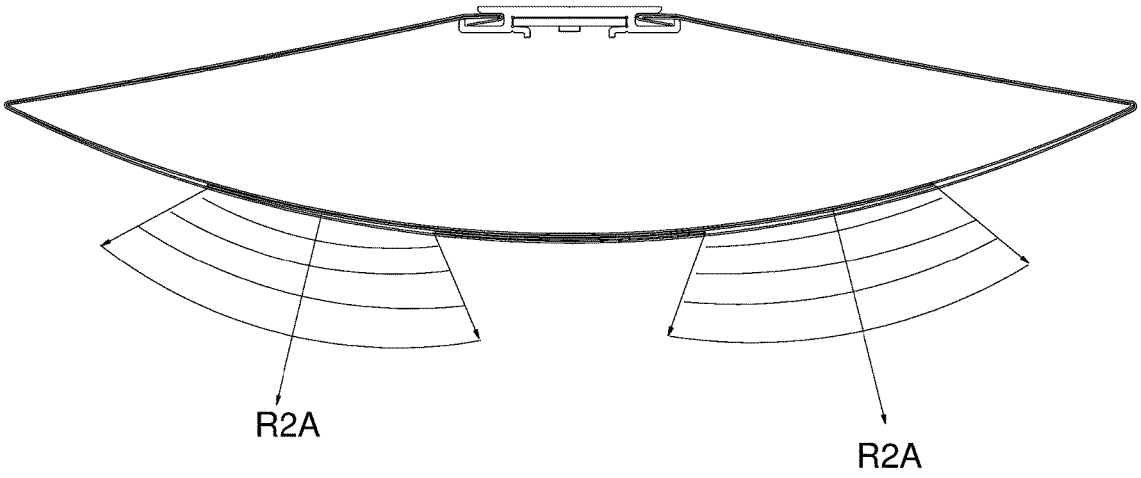
FIG. 8A shows a light distribution diagram of an example embodiment of The Apparatus.
Figure 8B:
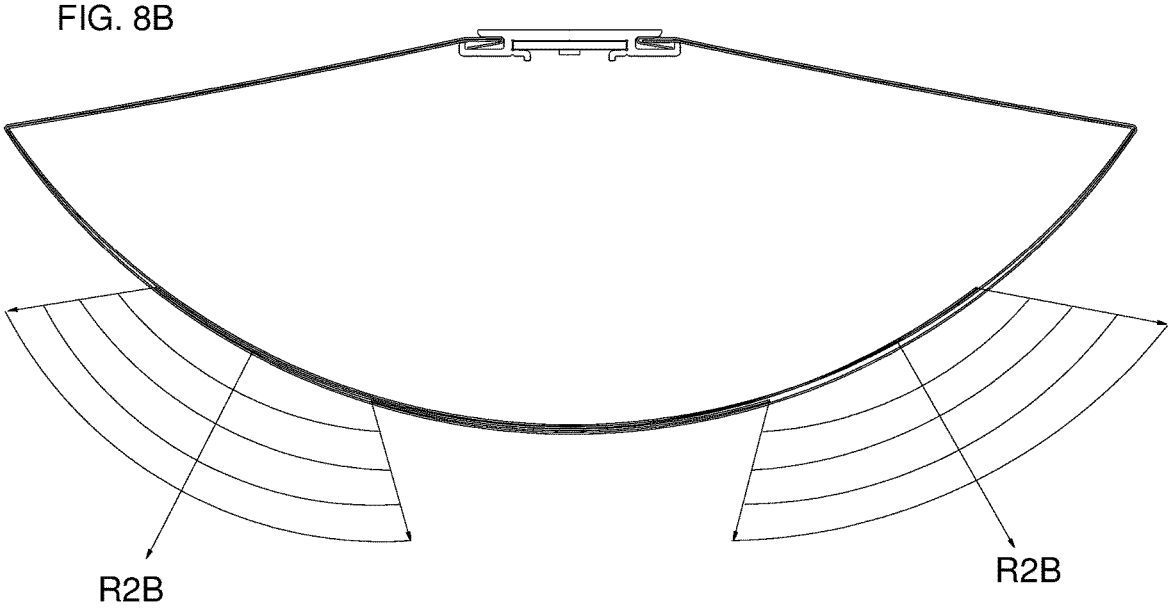
FIG. 8B shows another light distribution diagram of an example embodiment of The Apparatus wherein The Apparatus has a greater depth.

Referring to example embodiments of The Apparatus as shown in FIGS. 8A and 8B, FIG. 8A may be have a similar shaped profile as shown in previous example embodiments, and may have similar light distribution characteristics in R2A. (Zone 2 is being used for illustrative purposes, and a similar rational may be used for zones 1 and 3). In FIG. 8B, the depth of The Apparatus profile has increased, thus increasing the degrees of arc of the front light emitting face of The Apparatus. Zones R2B may show that the light distribution away from NADIR of The Apparatus has increased when compared FIG. 8A. Accordingly, light distribution in the 90 degree plane may also exhibit a wider distribution.

In example embodiments, referring to FIGS. 6A, 6B and 6C, the widths of LLFP1 and or LLFP2 6 may be varied in order to change the light dispersion characteristics of The Apparatus. Zone R1 may include the film layers LLFP1 and LLFP2 which may concentrate the light dispersion pattern as previously discussed. If the width film layer LLFP1 were narrowed, causing a corresponding decrease in the arc of R1, then less light from the brightest section of light from the LED array LEDR1 may refract through R1. Accordingly, zones R2 may have a greater arc, and more light may refract through zones R2. Using the same rationale, adjusting the arc of any of zones 1, 2 or 3 will have a corresponding effect on the other zones, thereby affecting the light distribution of The Apparatus. This method of adjusting the light distribution pattern of The Apparatus may allow more significant changes as compared to other methods previously discussed.

Figure 9:
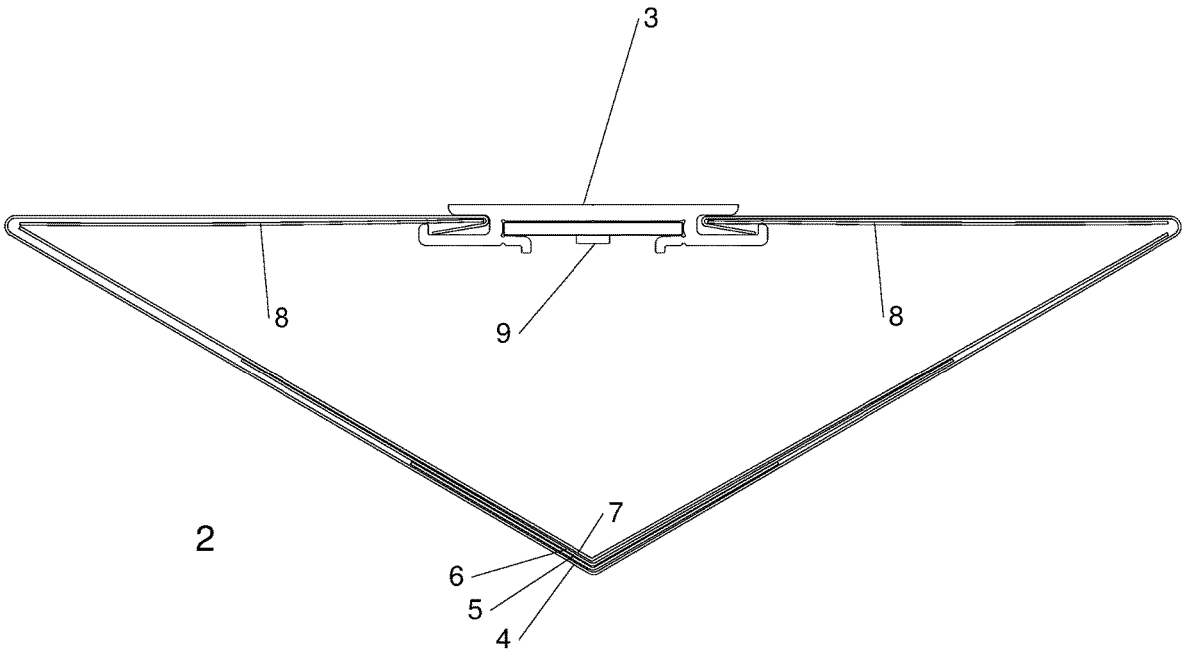
FIG. 9 shows a profile view an example embodiment of The Apparatus that has a V-shape.

Another example embodiment of The Apparatus is shown in FIG. 9. Instead of a curved profile of the front face of The Apparatus in previous example embodiments, the profile may be configured in a V-shape. The individual elements of The Apparatus 2 may be similar to those shown in previous example embodiments except for the shape, which may include outer lens 4, LLFP1 5, LLFP2 6, overlay 7, reflectors 8, LED array 9 and heat sink 3. The advantages of the V-shape may include more precise and more even control of the light distribution patterns due to the linearity of the lens elements. Also, different light distribution patterns may be realized that may not be possible with a curved lens shape, which may be beneficial in certain lighting applications.

In an example embodiment of the disclosed technology, a light modifying apparatus may comprise a curved outer layer with a front and back surface, wherein the back surface may be configured to receive incident light and the front surface may be configured to emit light, and the outer layer may comprise a substrate configured to modify light, wherein the curved outer layer may have an arc of length X. The light modifying apparatus may further comprise a second curved layer with a front and back surface, wherein the back surface may be configured to receive incident light and the front surface may be configured to emit light, wherein the front surface may be disposed on or in close proximity to the back surface of the outer layer, and wherein the second curved layer may have an arc of length Y wherein length Y is less than length X, and wherein the second curved layer may comprise a substrate comprising one or more surfaces comprising a lenticular lens configuration. The light modifying apparatus may have at least three light refractions zones, wherein light may be refracted differently through each of the two zones of the curved outer layer that is not disposed on or in close proximity to the second curved layer, compared to the light that is refracted through the zone that comprises the second curved layer with an arc of length Y.

In an example embodiment, a light modifying apparatus may comprise a third curved layer with a front and back surface, wherein the back surface may be configured to receive incident light and the front surface may be configured to emit light, wherein the front surface may be disposed on or in close proximity to the back surface of the second curved layer, and wherein the third curved layer has may have arc of length Z wherein length Z is less than length X but greater than length Y, and wherein the third curved layer may comprise a substrate comprising one or more surfaces comprising a lenticular lens configuration.

In an example embodiment, a light modifying apparatus may comprise a ridge on or near both outer edges of the curved outer layer wherein an additional substrate layer with a front and back surface may be disposed such that the front surface of the additional substrate layer may be disposed on or in close proximity to the back surface of the second curved layer or the third curved layer (if included therein), and wherein the additional substrate layer may be held in place through elastic potential energy between the ridges of the curved outer layer. The space between the curved outer layer and the additional substrate layer or layers may form a pocket that can securely hold the second and or third curved layer in place without any additional film fixing devices.

In an example embodiment, a light modifying apparatus may comprise a heat sink which may further comprises an LED array and a back surface of the curved outer layer, wherein the back surface may comprise two edges. Each of the two edges of the back surface of the curved outer lens may attach to corresponding edges of the heat sink.

In an example embodiment, a light modifying apparatus may further comprise one or more reflectors disposed on or in proximity to the back surface of the curved outer layer.

In an example embodiment of light modifying apparatus, the curved outer layer and the second curved layer are V-shaped instead of curved.

In an example embodiment of light modifying apparatus, a third curved layer is V-shaped instead of curved.

In an example embodiment of light modifying apparatus, modification to the depth of the light modifying apparatus may allow a corresponding change to the light distribution pattern thereof.

In an example embodiment of the disclosed technology, a light modifying apparatus may comprise a light modifying apparatus that has a light distribution pattern that may be adjusted. The adjustable light modifying apparatus may comprising a curved outer layer with a front and back surface, wherein the back surface may be configured to receive incident light and the front surface may be configured to emit light, and the outer layer may comprise a substrate configured to modify light, wherein the curved outer layer may have an arc of length X. The light modifying apparatus may further comprise a second curved layer with a front and back surface, wherein the front surface may be disposed on or in close proximity to the back surface of the outer layer, and wherein the second curved layer may be fabricated with an arc of length Y, wherein length Y may be any length that is less than length X, and wherein the second curved layer may comprise a substrate comprising one or more surfaces comprising a lenticular lens configuration. The adjustable light modifying apparatus may have at least three light refractions zones that may be fabricated to varying sizes, wherein light may be refracted differently through each of the two zones of the curved outer layer that is not disposed on or in close proximity to the second curved layer, compared to the light that is refracted through the zone that comprises the second curved layer with an arc of length Y, and varying said zone sizes may alter the light distribution pattern of the light modifying apparatus.

In an example embodiment of the enclosed technology, a method of securing optical film layers in a stack of multiple optical film layers may be provided. The method may comprise:

a) Utilize a an outer lens substrate with a front and back surface, wherein the back surface may be configured to receive incident light, and the front surface may be configured to emit light, and the outer layer may comprise a substrate configured to modify light, and the outer layer may further comprise a ridge on or near both edges of the outer layer.

b) Utilize another second layer with a front and back surface and insert the second substrate layer such that the front surface of the second layer may be disposed on, or in close proximity to the back surface of the outer lens substrate, wherein the second substrate layer may be held in place through elastic potential energy between the ridges of the outer lens substrate, wherein the space between the outer lens substrate and the second substrate layer may form a pocket that can securely hold a film piece sandwiched between the outer lens substrate and the second substrate layer without any additional film fixing devices.

c) Insert one or more optical film layers between the outer lens substrate and the second substrate layer.

While certain implementations of the disclosed technology have been described in connection with what is presently considered to be the most practical implementations, it is to be understood that the disclosed technology is not to be limited to the disclosed implementations, but on the contrary, is intended to cover various modifications and equivalent arrangements included within the scope of the appended claims. Although specific terms are employed herein, they are used in a generic and descriptive sense only and not for purposes of limitation.

This written description may use examples to disclose certain implementations of the disclosed technology, including the best mode, and may also to enable any person skilled in the art to practice certain implementations of the disclosed technology, including making and using any devices or systems and performing any incorporated methods. The patentable scope of certain implementations of the disclosed technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

I claim:

1. A light modifying apparatus comprising:

an elongated base comprising two opposing major edges and film attachment features on both opposing major edges;

multiple optical film layers comprising:

an outer layer comprising a piece of optical film configured to modify light and further comprising two major edges formed by folds in the optical film piece wherein the length between the folds is a distance X, a front and back surface between the folds wherein the back surface is configured to receive incident light and the front surface is configured to emit light, opposing major edges configured to attach to the film attachment features of the elongated base, and the dimensions of the piece of optical film are configured such that after attachment of the opposing major edges to the film attachment features of the elongated base, lateral compression of the piece of optical film forms a curve in the front surface;

an inner layer comprising a piece of optical film configured to modify light, and further configured with two major edges wherein the length between the two major edges is a distance Y, wherein distance Y is less than distance X, a front and back surface wherein the back surface is configured to receive incident light and the front surface is configured to emit light, and the inner layer is configured that after being laterally compressed, the two major edges of the inner layer are configured to engage with the corresponding folds in the optical film piece from the outer layer such that the inner layer is curved, held secure without film fixing devices and without distortions or sagging, and forms a pocket between the outer layer and the inner layer;

one or more middle layers comprising a piece of optical film configured with light condensing properties and further configured with two major edges, wherein the distance between the two major edges is a distance Z, wherein distance Z is less than distance Y, a front and back surface wherein the back surface is configured to receive incident light and the front surface is configured to emit light, and the one or more middle layers are configured to be held secure in the pocket between the outer and inner layers without film fixing devices and without distortions or sagging; and wherein the outer, inner and one or more middle layers together form at least three light refraction zones, wherein light is refracted differently through each of the at least three light refraction zones.

2. The light modifying apparatus of claim 1, wherein the elongated base comprises a heat sink which further comprises one or more LED arrays.

3. The light modifying apparatus of claim 1 further comprises one or more reflectors disposed beneath the multiple optical film layers such that back scattered light from any layer, or direct or indirect light from an LED array may be efficiently redirected through the front surface of outer layer.

4. The light modifying apparatus of claim 1, wherein at least the outer layer is configured from a larger or smaller size of substrate with an arc length greater or less than X, such that the depth of the light modifying apparatus will be changed accordingly, wherein modification to the depth of the light modifying apparatus allows a corresponding change to the light distribution pattern thereof.

5. A light modifying apparatus comprising:

an adjustable light modifying apparatus that has a light distribution pattern that may be adjusted, the adjustable light modifying apparatus comprising:

an elongated base comprising two opposing major edges and film attachment features on both opposing major edges;

multiple optical film layers comprising:

an outer layer comprising a piece of optical film configured to modify light and further comprising two major edges formed by folds in the optical film piece wherein the distance between the folds is a distance X, a front and back surface between the folds wherein the back surface is configured to receive incident light and the front surface is configured to emit light, opposing major edges configured to attach to the film attachment features of the elongated base, and the dimensions of the piece of optical film are configured such that after attachment of the opposing major edges to the film attachment features of the elongated base, lateral compression of the piece of optical film forms a curve in the front surface;

an inner layer comprising a piece of optical film configured to modify light, and further configured with two major edges wherein the distance between the two major edges is a distance Y, wherein distance Y is less than distance X, a front and back surface wherein the back surface is configured to receive incident light and the front surface is configured to emit light, and the inner layer is configured that after being laterally compressed, the two major edges of the inner layer are configured to engage with the corresponding folds in the optical film piece from the outer layer such that the inner layer is curved held secure without film fixing devices and without distortions or sagging, and forms a pocket between the outer layer and the inner layer;

one or more middle layers comprising a piece of optical film configured with light condensing properties and further configured with two major edges, wherein the distance between the two major edges is a distance Z, wherein distance Z is less than distance Y, a front and back surface wherein the back surface is configured to receive incident light and the front surface is configured to emit light, and the one or more middle layers are configured to be held secure in the pocket between the outer and inner layers without film fixing devices and without distortions or sagging; and wherein the outer, inner and one or more middle layers together form at least three light refraction zones, wherein light is refracted differently through each of the at least three light refraction zones, and wherein the one or more middle layers may be fabricated to varying sizes thereby creating various sized refraction zones.

6. A method of securing optical film layers in a stack of multiple optical film layers, the method comprising:

creating an elongated base comprising two opposing major edges and film attachment features on both opposing major edges;

creating an outer layer comprising a piece of optical film configured to modify light and further comprising two major edges formed by folds in the optical film piece wherein the distance between the folds is a distance X, a front and back surface between the folds wherein the back surface is configured to receive incident light and the front surface is configured to emit light, opposing major edges configured to attach to the film attachment features of the elongated base, and the dimensions of the piece of optical film are configured such that after attachment of the opposing major edges to the film attachment features of the elongated base, lateral compression of the piece of optical film forms a curve in the front surface;

laterally compressing the outer layer piece of optical film and attaching the opposing major edges to the film attachment features of the elongated base, thereby creating a curved front surface on the outer layer;

creating an inner layer comprising a piece of optical film configured to modify light, and further configured with two major edges wherein the distance between the two major edges is a distance Y, wherein distance Y is less than distance X, a front and back surface wherein the back surface is configured to receive incident light and the front surface is configured to emit light;

laterally compressing the two major edges of the inner layer and engaging them with the corresponding folds in the optical film piece from the outer layer such that the inner layer is curved, held secure, and forms a pocket between the outer layer and the inner layer;

inserting one or more middle layers in the pocket between the inner and outer layers, the one or more middle layers comprising one or more pieces of optical film.

* * * * *